US009493986B2

(12) United States Patent
Jeffryes et al.

(10) Patent No.: US 9,493,986 B2
(45) Date of Patent: Nov. 15, 2016

(54) GAS INJECTION WHILE DRILLING

(75) Inventors: Benjamin P. Jeffryes, Histon (GB); Ashley Bernard Johnson, Milton (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 224 days.

(21) Appl. No.: 14/117,518

(22) PCT Filed: May 25, 2012

(86) PCT No.: PCT/US2012/039511

§ 371 (c)(1),
(2), (4) Date: Dec. 20, 2013

(87) PCT Pub. No.: WO2012/166573

PCT Pub. Date: Dec. 6, 2012

(65) Prior Publication Data

US 2015/0041213 A1 Feb. 12, 2015

Related U.S. Application Data

(60) Provisional application No. 61/490,733, filed on May 27, 2011.

(51) Int. Cl.

| | |
|---|---|
| ***E21B 21/12*** | (2006.01) |
| ***E21B 7/00*** | (2006.01) |
| ***E21B 21/16*** | (2006.01) |
| ***E21B 17/18*** | (2006.01) |

(52) U.S. Cl.

CPC ..... *E21B 7/00* (2013.01); *E21B 17/18* (2013.01); *E21B 21/12* (2013.01); *E21B 21/16* (2013.01)

(58) Field of Classification Search

CPC ..... E21B 43/12; E21B 43/18; E21B 43/20
See application file for complete search history.

(56) References Cited

U.S. PATENT DOCUMENTS

| | | | | |
|---|---|---|---|---|
| 4,253,530 | A | 3/1981 | Sharki et al. | |
| 5,249,635 | A | 10/1993 | King et al. | |
| 5,873,420 | A | 2/1999 | Gearhart | |
| 2004/0065440 | A1* | 4/2004 | Farabee | E21B 21/08 166/358 |
| 2011/0100635 | A1 | 5/2011 | Williams | |
| 2015/0308204 | A1* | 10/2015 | Johnson | E21B 21/08 700/282 |

OTHER PUBLICATIONS

International Search Report of PCT Application No. PCT/IB2012/039511 (IS10.0733-WO-PCT) dated Dec. 12, 2012: pp. 1-2.

Urbieta et al., "IADC/SPE 122198: First Application of Concentric Nitrogen Injection Technique for a Managed Pressure Drilling Depleted Well in Southern Mexico," SPE International, 2009: pp. 1-17.

* cited by examiner

*Primary Examiner* — William P Neuder

(57) ABSTRACT

Injection of gas into a managed pressure drilling system to provide for operation of the drilling system in a downhole pressure window defined by the pore pressure of a formation being drilled and a fracture pressure of the formation. Gas injection being controlled so as to produce the desired downhole pressure without causing large oscillations in borehole pressure.

19 Claims, 6 Drawing Sheets

GAS INJECTION WHILE DRILLING

PRIORITY

This application is the United States National Stage Application under 35 U.S.C. §371 of Patent Cooperation Treaty Application No. PCT/US2012/039511 filed May 25, 2012, which claims the benefit of U.S. Provisional Patent Application Ser. No. 61/490,733 filed May 27, 2011. Both of these applications are incorporated herein by reference in their entireties.

BACKGROUND OF THE DISCLOSURE

The present invention relates to a method of drilling a subterranean borehole, particularly, but not exclusively, for the purpose of extracting hydrocarbons from a subterranean reservoir.

The drilling of a borehole is typically carried out using a steel pipe known as a drillstring that is coupled with a drill bit on its lowermost end. The entire drillstring may be rotated using an over-ground drilling motor, or the drill bit may be rotated independently of the drill string using a fluid powered motor or motors mounted on the drillstring just above the drill bit. As drilling progresses, a flow of drilling fluid is used to carry the debris created by the contact between the drill bit and the formation being drilled during the drilling process out of the wellbore. The drilling fluid is pumped through an inlet line down the drillstring and through the drill bit, and returns to the surface via an annular space between the outer diameter of the drillstring and the borehole (generally referred to as the annulus).

Drilling fluid is a broad drilling term that may cover various different types of drilling fluids. The term 'drilling fluid' may be used to describe any fluid or fluid mixture used during drilling and may cover such things as air, nitrogen, misted fluids in air or nitrogen, foamed fluids with air or nitrogen, aerated or nitrified fluids to heavily weighted mixtures of oil or water with solid particles.

The drilling fluid flow through the drillstring may be used to cool the drill bit. In conventional overbalanced drilling, the density of the drilling fluid is selected so that it produces a pressure at the bottom of the borehole ("the bottom hole pressure" or "BHP"), which is high enough to counter-balance the pressure of fluids in the formation surrounding the borehole (often referred to as the "formation pore pressure"). By counter-balancing the pore pressure, the BHP acts to prevent the inflow of fluids from the formations surrounding the borehole into the borehole that is being drilled. However, if the BHP falls below the formation pore pressure, formation fluids, such as gas, oil and/or water may enter the borehole and produce, what is referred to in the drilling industry as a kick. By contract, if the BHP is very high, the BHP may be higher than the fracture strength of the formation surrounding the borehole, and this high BHP may then result in fracturing of the formation surrounding the borehole, which may in turn lead to loss of fluid from the borehole into the formation. Consequently, when the formation is fractured in this way, the drilling fluid may enter the formation and be lost from the drilling process. This loss of drilling fluid from the drilling process may cause a reduction in BHP and as a consequence cause a kick as the BHP falls below the formation pore pressure.

In order to overcome the problems of kicks and/or fracturing of formations during drilling, a process known as managed pressure drilling has been developed. In managed pressure drilling various techniques may be used to control, the BHP during the drilling process. These techniques may include flowing a gas into the borehole in order to reduce the BHP that is created by fluids, mainly drilling fluids in the borehole.

BRIEF SUMMARY OF THE DISCLOSURE

In an embodiment of the present invention, a method for injecting gas into a borehole in a subterranean formation during a drilling procedure is provided. In the drilling procedure a drillstring is extended from a location at an Earth surface to a bottom of a borehole being drilled in the drilling process, the drillstring being attached at its downhole end to a drill bit. The method involves pumping gas through a gas injector into an annulus formed by the drillstring and the borehole, and also pumping gas down through the drillstring. In certain aspects, the gas is pumped through the drillstring with a flow rate that is equal to the flow of the gas that is pumped through the annulus, where the pumped flow rate of the gas is selected to produces a desired pressure at the bottom of the borehole.

In one embodiment of the present invention, a method for initiating gas injection into a borehole during a drilling procedure is provided. The method may provide among other things for initiating gas injection without causing large oscillations in the pressures/fluid flows in the borehole.

In one aspect, a method for injecting gas into a borehole in a subterranean formation during a drilling procedure is provided where the method comprises pumping gas into a gas injector, wherein the gas injector is in fluid communication with an annulus surrounding a drillstring, and wherein the drillstring extends from a location at an Earth surface to a bottom of the borehole and comprises a drill bit for drilling the borehole; and pumping gas down the drillstring through the drill bit and into the annulus, wherein the gas is pumped through the gas injector with a certain flow rate and the certain flow rate is a rate of flow of the gas through the annulus that produces a desired pressure at the bottom of the borehole.

In another aspect, a method for initiating gas injection into a borehole in a managed pressure drilling process during a drilling procedure is provided, the method comprising: pumping a volume of gas into a gas injector to charge the gas injector, to a charging pressure, wherein the gas injector is in fluid communication with an inner annulus formed by cylindrical tubing surrounding a drillstring and the fluid communication between the gas injector and the inner annulus is provided by one or more orifices, and wherein the drillstring extends from a location at an Earth surface down into the borehole and the drillstring comprises a drill bit at an end distal from the Earth surface; pumping a quantity of gas down the drillstring through the drill bit and into the annulus; and pumping gas through the gas injector into the inner annulus at a specific flow rate, wherein the specific flow rate is configured to produce a desired bottomhole pressure in the borehole.

In a further aspect a system for injecting gas into a borehole during a drilling procedure is provided, the system comprising: an injection tubing for transporting gas; a first pump for pumping gas into the injection tubing; a fluid communication pathway comprising one or more orifices between the injection tubing and an annulus surrounding a portion of a drillstring, wherein the drillstring extends from a surface location to a bottom of the borehole and the drillstring includes a drill bit at a lower end of the drillstring in the borehole for drilling the borehole through a subterranean formation during the drilling process; a second pump for pumping gas into the drillstring and through the drill bit into the annulus; and one or more processors, wherein at least one of the one or more processors is configured to control the first pump and at least one of the one or more processors is configured to control the second pump.

BRIEF DESCRIPTION OF THE DRAWINGS

The present disclosure is described in conjunction with the appended figures.

Figure 1:
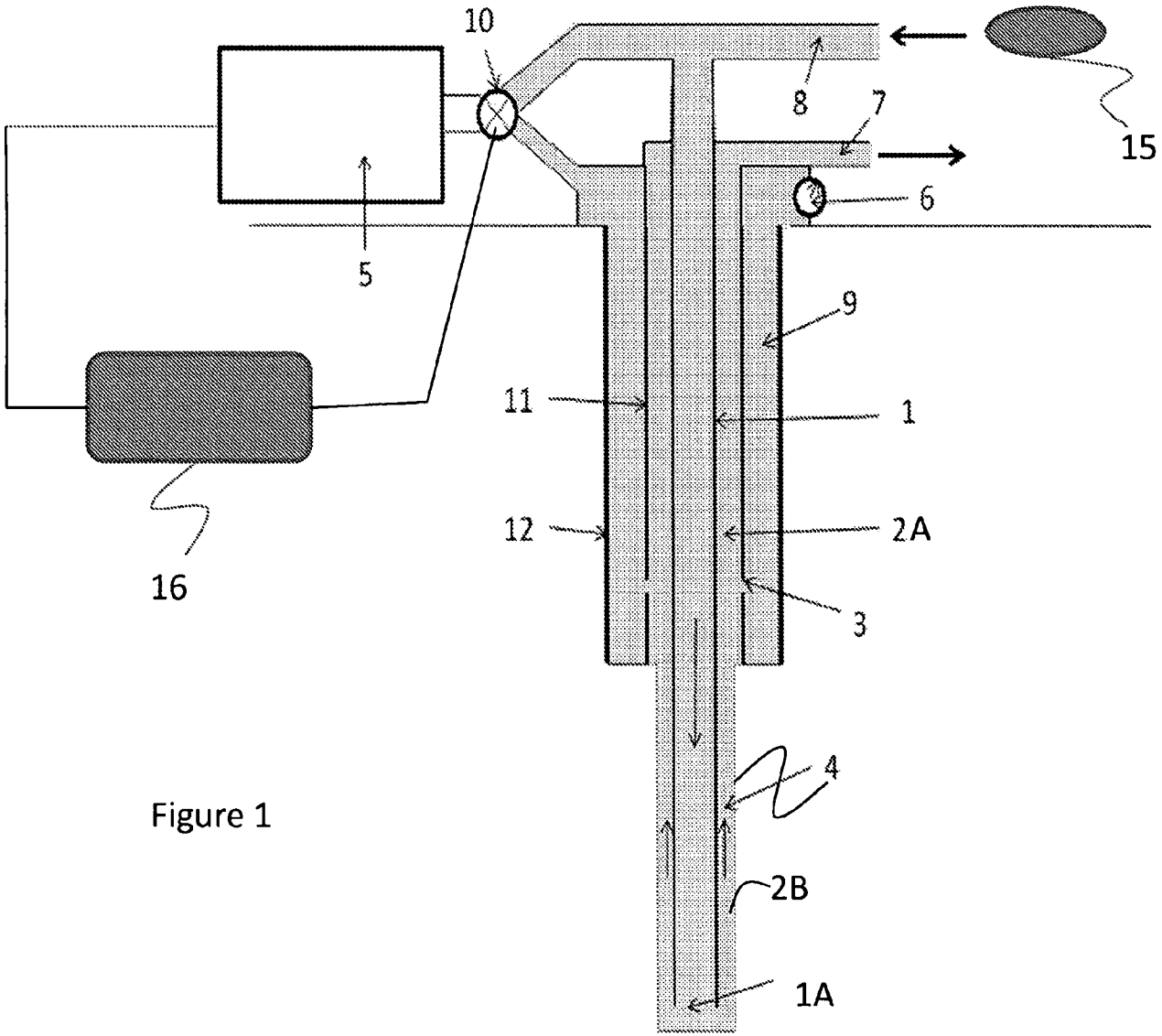
FIG. 1 illustrates a managed pressure drilling system comprising a secondary annulus, in accordance with an embodiment of the present invention.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DESCRIPTION

The ensuing description provides preferred exemplary embodiment(s) only, and is not intended to limit the scope, applicability or configuration of the invention. Rather, the ensuing description of the preferred exemplary embodiment (s) will provide those skilled in the art with an enabling description for implementing a preferred exemplary embodiment of the invention. It being understood that various changes may be made in the function and arrangement of elements without departing from the scope of the invention as set forth in the appended claims.

Specific details are given in the following description to provide a thorough understanding of the embodiments. However, it will be understood by one of ordinary skill in the art that the embodiments maybe practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Moreover, as disclosed herein, the term "storage medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "computer-readable medium" includes, but is not limited to portable or fixed storage devices, optical storage devices, wireless channels and various other mediums capable of storing, containing or carrying instruction(s) and/or data.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium such as storage medium. A processor(s) may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

Managed pressure drilling is a drilling method that allows for managing the BHP during drilling operations. In one aspect, managed pressure drilling allows for reduction of the BHP during the drilling process. Managed pressure drilling ("MPD") may be used to actively control the pressure during the drilling process to address the issues of kicks, loss of circulation of drilling fluid due to egress of the drilling fluid through fractures into the formation, formation fracturing, formation damage, or formation collapse. MPD may be particularly applicable when the formation pressure around the borehole section being drilled has fallen below an original formation pressure at the start of the drilling process or where there is a narrow operational window between the BHP at which the formation will fracture ("the fracture pressure") and the formation pressure.

In MPD, the annulus may be closed using a pressure containment device. This device includes sealing elements, which engage with the outside surface of the drillstring so that flow of fluid between the sealing elements and the drill string is substantially prevented, The sealing elements may allow for rotation of the drillstring in the borehole so that the drill bit on the lower end of the drillstring may be rotated. A flow control device may be used to provide a flow path for the escape of drilling fluid from the annulus. After the flow control device, a pressure control manifold with at least one adjustable choke or valve may be used to control the rate of flow of drilling fluid out of the annulus. When closed during drilling, the pressure containment device creates a back pressure in the wellbore, and this back pressure can be controlled by using the adjustable choke or valve on the pressure control manifold to control the degree to which flow of drilling fluid out of the annulus (or riser) is restricted.

During MPD a processor and sensors and/or an operator may monitor and compare the flow rate of drilling fluid into the drillstring with the flow rate of drilling fluid out of the annulus. From this comparison, the functioning of the drilling process may be interpreted. For example, if less drilling fluid is emerging from the annulus than has been pumped into the borehole, than it is likely fluid loss is occurring in the borehole as a result of fracturing of the formation whereas if more fluid is emerging from the annuls than was being pumped into the borehole a kick may have occurred and formation fluids may be entering the borehole. As such, a sudden increase in the volume or volume flow rate out of the annulus relative to the volume or volume flow rate into the drill string may indicate that there has been a kick. By contrast, a sudden drop in the flow rate out of the annulus/relative to the flow rate into the drillstring may indicates that the drilling fluid has penetrated the formation.

In some MPD procedures, gas may be pumped into the annulus between the drillstring and the borehole wall in order to reduce BHP during the drilling procedure. Gas may be introduced into the annulus at the bottom or near to the bottom of the borehole by pumping gas through the drillstring through the drill bit and into the annulus. In other MPD gas may be pumped into a top section of the annulus using an injector. In either case, the gas in the annulus helps to reduce the BHP.

In aspects of the present invention, gas may be pumped into the annulus using an injector, which may comprise a second annulus that surrounds first annulus. In such aspects, a combination of pumping gas down the drillstring and injecting gas into the first annulus may be used to introduce gas into the borehole and manage the bottomhole pressure. By pumping gas into the annulus and/or a section of the annulus, the weight/volume of the drilling fluid in the annulus may be decreased so decreasing the BHP An issue that may be experienced with MPD is that the initiation of the process may cause fluctuations in the pressure in the borehole and or the flow of the fluids in the borehole. For example, high pressures and or large volumes of gas may be needed to commence the flow of gas down the drillstring and into the annulus. Similarly, high pressures and or large volumes of gas may be needed to commence the flow of gas through an injector into a section of the annulus. As such, initiating the process of gas injection into the annulus so that the well un-loads and the bottomhole pressure is reduced/controlled can be problematic as it can produce large fluctuations in borehole pressure and achieving a steady-state may take hours of unproductive time and require large volumes of gas. For example, if gas is simply pumped into the annulus through the drillstring and/or an injector to relieve bottomhole pressure, the injection of the gas may create perturbations in the fluid flow in the borehole and borehole pressures may swing erratically so that drilling of the borehole has to be stopped until the fluctuations cease.

FIG. 1 illustrates a managed pressure drilling system comprising a secondary annulus, in accordance with an embodiment of the present invention. As depicted, a drillstring (1) is suspended in a borehole (4). In the upper section of the borehole (4) there is an inner annulus (2A) and a casing string (11) that is hydraulically connected/in fluid communication with an outer annulus (9) through one or more orifices (3). The outer annulus (9) may also be cased by a second casing string (12).

The outer annulus (9) may comprise an upper section of an annulus (2B) that is defined between the drillstring (1) and an inner-wall of the borehole (4). The casing string (11) and/or the second casing string (12) may comprise metallic pipe. The one or more orifices (3) may comprise openings in the casing string (11) and may include valves, injectors and/or the like for controlling the amount of fluid communication provided between the outer annulus (9) and the inner annulus (2A).

In an embodiment of the present invention, drilling fluid (often referred to in the industry as drilling mud or more simply as mud may be pumped during drilling procedures from a pump(s) (15) through pipework (8) into the drillstring (1). The mud may be pumped down the drillstring (1) through a distal end (1A) of the drillstring (1) before returning via the inner annuli (2B) and (2A) and return pipework (7) to fluid tanks (not shown) where the returned drilling mud for may be stored, preparing for further use in the drilling procedure and/or the like.

Between the pipework (7) and the fluid tanks (not shown) the system may comprise one or more chokes and separators (not shown). In an embodiment of the present invention, gas may be pumped into pipes feeding the top of the drillstring (1), the inner annulus (2A) and/or the outer annulus (9) by one or more gas pumps (5). In an embodiment of the present invention, a valve manifold (10), may direct the gas either to the drillstring feed through which the gas flows into the drillstring (1), to the outer annulus (9) or to both the drillstring (1) and the outer annulus (9) at the same time. In other aspects of the present invention, the valve manifold (10) may also direct gas to flow into the inner annulus (2A).

In an embodiment of the present invention, sensors (not shown) may be used to measure a pressure in the outer annulus (9), the inner annulus (2), the drillstring (1) and/or the like. Further sensors (not shown) may be used to measure the flow of the drilling fluid and the like into/out of the outer annulus (9), the inner annulus (2) and/or the drillstring (1). A processor (16) may be in electronic communication with the pump (5), the valve manifold (10), the sensors and/or the like. In embodiments of the present invention, the processor (16) may be used to control the pump (5), the valve manifold (10), the sensors and/or the like. In addition to the described equipment, there may be many other pieces of equipment at the surface, such as blow-out-preventers, a rotating-control-head, etc, which are normal with managed-pressure drilling, but which may not be involved in the procedure detailed here, and hence not shown.

Annular gas injection is a process that may be used for reducing the bottomhole-pressure in the borehole (4). In many annular gas injection systems, in addition to the casing string (11) in the borehole (4) (where the casing is a tubing/liner that is often made of steel that lines the borehole to give it stability and may in some cases be cemented to the wall of the borehole), the borehole (4) comprises a secondary annulus, the outer annulus (9). This secondary annulus may be connected by one or more orifices (3) at one or more depths to the primary annulus, the inner annulus (2A). In operation, the drilling fluids may flow up though the annulus (2A) and (2B) during the drilling procedures to the surface. In some aspects, the fluids are processed on the surface and reintroduced into the borehole (4), as the drilling process continues, through the drillstring (1).

In a MPD technique in accordance with an embodiment of the present invention, gas may be injected into the outer annulus (9) and through the orifices (3) into the inner annulus (2A). This flow of gas serves to lower a fluid level of the drilling fluids etc. in the inner annulus (2A) to the level/depth(s) of the orifices (3). The gas that is pumped into the outer annulus (9) passes into the main flow path of the drilling fluid in the inner annulus (2A) and rises to the surface along with the drilling fluid. In so doing, the gas expands in the inner annulus (2A) and, as a result pressure in the borehole (4), including the pressure at the bottom of the borehole (4) is reduced. In an embodiment of the present invention, at the top of the borehole (4) a means of controlling the pressure, such as a rotating control head, valve, choke and/or the like, is used to manage the pressure in the borehole (4).

In the illustrated MPD system, if gas flow is initiated simply by pumping gas into the outer annulus (9), then the pressure at which it enters the borehole (4) is simply the depth of the orifices (3), multiplied by the density of the drilling fluid and the gravitational constant—plus a correction factor for frictional effects. When stable flow is achieved, the pressure in the outer annulus (9) is much lower, since the average density of the drilling fluid in the borehole above the orifices (3) is reduced by the presence of the gas.

In an embodiment of the present invention, a desired final flowing pressure of the gas through the inner annulus (2A) may be determined. This final flowing pressure through the annulus may in some aspects be determined using the downhole pressure desired for the drilling procedure. This desired drilling pressure may be based on measurements made on the formation—such as formation strength, pore pressure measurements etc.—drilling fluid weight, bottomhole pressure and/or the like. The measurements may in some embodiments be made while drilling using sensors on the drillstring (1), on a bottomhole assembly coupled with the distal end (1A) of the drillstring (1) (where the bottomhole assembly comprises a drill bit for cutting the borehole (4)) and/or the like and the measurements may be used to calculate desired managed pressures during the drilling procedure.

In some aspects, modeling, experiments, previous experience and or the like may be used to determine the desired drilling pressure/bottomhole pressure. In an embodiment of the present invention, once the desired bottomhole pressure has been determined, a gas flow rate in the annulus to produce the desired bottomhole pressure may be processed. In an embodiments of the present invention, gas is injected into the borehole from the secondary annulus at a pressure that is close to the final flowing pressure that is to be achieved in the annulus to produce the desired bottomhole pressure. By injecting the gas at a pressure close to this final flowing pressure, rather than more quickly, oscillations in flow and pressure can be controlled. In an embodiments of the present invention, by matching the injection pressure to the desired flowing pressure of the gas in the annulus, perturbations of the drilling system, such as perturbations to pressure and fluid flow rates or the like, are reduced.

In one embodiment of the present invention, a desired borehole pressure is calculated for a drilling process while drilling procedure is occurring and the gas is injected into the secondary annulus at a rate that is close to the flow rate of the gas in the primary annulus that is necessary to provide the determined borehole pressure. In other embodiments, the flow rate of the gas in the secondary annulus is continuously controlled to maintain the desired pressure at the bottom of the borehole. This control is provided by pumping the gas into the secondary borehole at a rate close to the rate required to provide the desired pressure as continuous control is not possible when pressure and flow is oscillating.

In some embodiments, the gas injection is controlled automatically by the processor (16). In such embodiments, logging while drilling tools may produce data regarding the formation such as pore pressure, formation characteristics (strength, composition and/or the like), pressure in the bottom of the borehole and/or the like. Additionally, sensors may provide data regarding the flow of fluids into and out of the borehole, measurements concerning properties of the drilling fluid and/or the like. The processor may receive this data and may process a desired range of pressures for the bottom of the borehole. The processor may also calculate a flow rate for gas to flow down the drillstring through the bottom of the borehole and up the annulus to produce the desired bottomhole pressure. Once this flow rate has been processed, gas is pumped into the outer annulus (9) at a rate sufficient to produce a gas flow equivalent to the processed flow rate. In this way the annulus is charged with gas and when gas is then pumped down the drillstring at the processed flow rate the drilling system remains close to a steady state with gas flowing steadily through the system rather than cause large oscillations in pressure and/or fluid flow. Moreover, in embodiments of the present invention, the charging of the annulus through the outer annulus (9) can have almost immediate effects on the bottomhole pressure.

Figure 2:
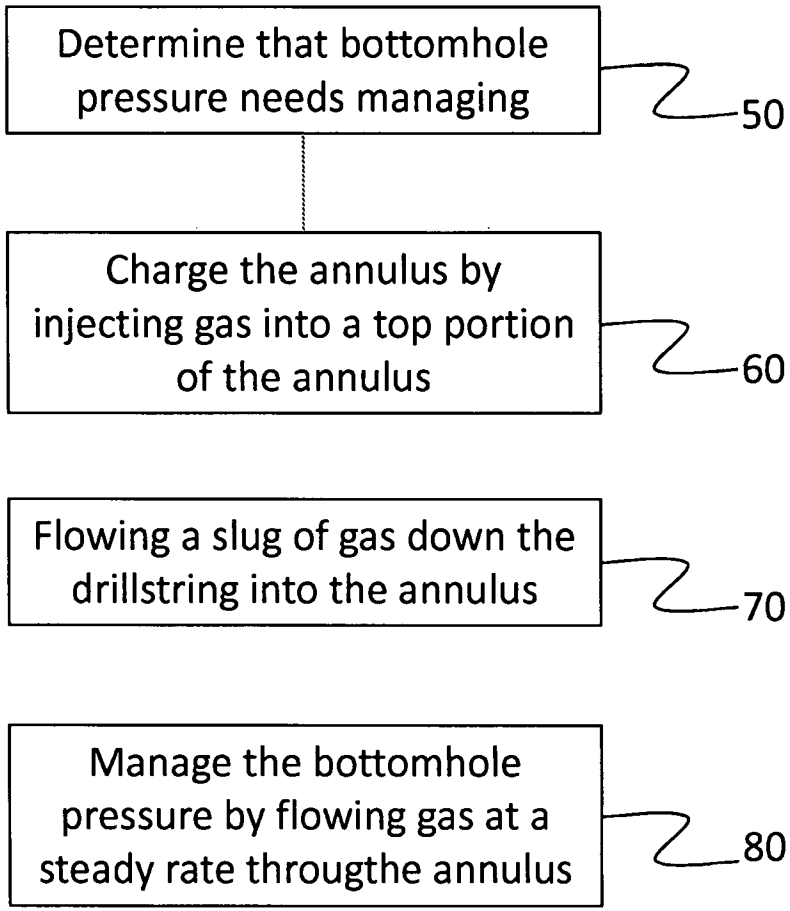
FIG. 2 illustrates a flow-type diagram for initiating gas flow into a borehole to manage bottomhole pressure in accordance with an embodiment of the present invention.

FIG. 2 illustrates a flow-type diagram for initiating gas flow into a borehole to manage bottomhole pressure in accordance with an embodiment of the present invention.

In step 50, a determination is made that the bottomhole pressure needs to be managed. For example, measurements in the borehole, formation measurements, fluid flow measurements and/or the like may be used to determine that the bottomhole pressure of the borehole being drilled is moving outside of a window, i.e, moving towards a high pressure that may result in fracturing of the formation or moving towards a low pressure that may result in inflow of formation fluids into the borehole.

In embodiments of the present invention, measurements may be made during the drilling process to determine the desired pressure window and/or the downhole pressure. In such embodiments, bottomhole pressure may be monitored and managed during the drilling process.

In step 60, once a determination has been made that the bottomhole pressure needs managing, the annulus is charged by injecting gas into a top portion of the annulus. In an embodiment of the present invention, a flow rate and or gas pressure to be developed in the annulus to keep the bottomhole pressure in the desired pressure window is processed. For example, the flow rate of the drilling fluid in the borehole, the downhole pressure, the weight of the drilling fluid and/or the like may be used to process a flow rate of gas in the annulus and or/a pressure to be achieved in the annulus by gas injection, which will result in a desired bottomhole pressure.

Once this desired flow rate has been processed, gas is injected into an outer annulus at the rate that has been processed as being the flow rate necessary in the annulus to achieve the desired bottomhole pressure and/or at a pressure that will create an annular pressure that will achieve the desired BHP.

By controlling the flow rate to the steady state flow rate desired in the annulus and/or limiting the volume of the injected gas to that necessary to reach the orifices between the secondary and primary annuli, embodiments of the present invention prevent creating large oscillation in the pressure in the borehole (drillstring and/or primary annulus) and/or flow of the fluids in the borehole during the charging step In step 70, gas is injected down the drillstring, through the drill bit and into the annulus. This flow of gas through the annulus reduces the bottomhole pressure. In an embodiment of the present invention, after the top of the annulus is charged with gas, gas in pumped in to the drillstring to reduce the bottomhole pressure. In an embodiment of the present invention, a flow rate, pressure is processed for the gas to be introduced into the annulus that will produce a desired change in the bottomhole pressure. The processes of flowing gas through the drillstring into the annulus and/or through the outer annulus into the annulus may each or in combination reduce the BHP.

In one embodiment of the present invention, to initiate pumping of gas into the annulus to reduce BHP and avoid causing large pressure/flow oscillations in the primary annulus, the secondary annulus is charged by flowing enough volume of gas into the secondary annulus such that the gas in the secondary annulus extends to the orifices between the annuli, but with little gas flowing through to the primary annulus. In this way, gas is not forced into the primary annulus and does not cause large pressure oscillations in the primary annulus.

Only substantially as much gas as would reach down to the orifices between the secondary and primary annuluses is pumped through the gas injector, the secondary annulus. This amount of gas may be calculated as the amount of gas necessary to flow from a surface location to the orifices once stable flow has been achieved through the drilling system. In an embodiment of the present invention, an unforeseen factor is that since initially, prior to and at the beginning of the injection of gas into the secondary annulus, the drilling fluid in the top of the borehole is at its original density, when the gas is first pumped into the secondary annulus, the gas will be at a higher pressure and occupy a reduced volume, compared to when the gas is flowing through the drilling system, and so, even though the volume of injected gas is calculated to reach down to the orifices when the gas is flowing through the drilling system, the injected gas will not reach down as far as the orifices under the initial conditions. If this factor is not considered, more gas than is necessary maybe injected into the secondary annulus and result in creating oscillations in the gas flow through the drilling system and the use/consumption of large amounts of unnecessary gas.

In embodiments of the present invention, by pumping in a slug of gas of defined volume to charge the top of the annulus, rather than circulating gas through the top section, large perturbations/oscillations in the pressure of the fluid in the top portion of the annulus are avoided. In fact the closer the volume is to that required to reach the orifices between the primary and the secondary annulus, the smaller the perturbations/oscillations. In some embodiments of the present invention, one or more sensors may be disposed along the secondary annulus and/or the primary annulus to detect a presence, flow rate, pressure and/or the like of the gas that is being injected into the annulus. In such embodiments, output from the sensors may be processed and used to control the gas injection. In some embodiments, once it has been detected that the gas has reached the orifices between the secondary and primary annulus gas injection through the secondary annulus may be ceased. In some aspects, forward modeling may be used with the sensed location of the gas, flow rate of the gas and/or pressure of the gas to determine when to stop the injection of gas through the secondary annulus such that the gas reaches down the secondary annulus to the orifices.

In an embodiment of the present invention, in step 70, as a lug of gas is pumped down the drillstring and into the annulus. The slug of gas comprises a volume of gas that will, as it passes up the annulus, create a gas train that extends from the orifices in the annulus up to the surface. This volume may be processed based on the borehole, drillstring, drilling fluid and/or the like properties and/or measurements made in the borehole, drillstring, annulus and/or the like. For example sensors may be disposed appurtenant to the orifices to detect when is in the vicinity of the orifices, a flow rate of gas at the orifices, a concentration/volume of gas at the orifices and/or the like. By using a slug of gas of limited volume rather than simply continuously pumping gas into the borehole an/d/or pumping large volumes of gas into the annulus, large pressure oscillation in the borehole/annulus may be avoided.

In step 80, once the slug of gas has created a train of gas between the orifices and the surface, gas may be steadily pumped through the secondary annulus and the orifices into the primary annulus. This steady flow places a steady volume of gas in the annulus, which volume of gas in the annulus reduces the BHP.

In some embodiments, gas may be flowed at a steady rate down the drillstring, at essentially/substantially/close to the same flow rate as the flow rate that will be used through the primary annulus during the MPD process. In aspects of the present invention, the flow rate of the gas through the primary annulus during the MPD process may be the flow rate that is determined as being necessary to achieve a selected downhole pressure. The selected downhole pressure may be a pressure that lies within a pressure window, i.e., above the pore pressure of the formation being drilled and below the fracture pressure of the formation. In certain aspects of the present invention, the selected pressure and/or the flow rate of the gas through the primary annulus or the secondary annulus to achieve this selected pressure may be determined by modeling, experimentation, prior experience in similar drilling conditions or may be processed from measurements made on the formation being drilled. Where the selected gas pressure and/or the gas flow rate to achieve the selected pressure is processed from measurement, the measurements may be made while the drilling operation is occurring, may be based on measurements made downhole or above ground on the formation or samples of the formation and/or the like.

In some embodiments of the present invention, a processor in communication with one or more sensors disposed along the secondary annulus and/or the primary annulus may be used to process a flow rate of the gas. In some embodiments, the processor may control the gas injection through the drillstring to provide that the gas flow rate is maintained at a rate necessary to keep the bottomhole pressure within a desired window. In other aspects, the processor may control the gas injection through the secondary annulus to provide that the gas flow rate of the injected gas is equivalent to a steady flow rate of a gas flow through the drillstring that will produce a desired bottomhole pressure.

In one embodiment of the present invention, the three stages for initiating gas flow through the drilling system to manage the downhole pressure may comprise:

(i) One—Pump gas into the primary annulus;

(ii) Two—Pump a slug of gas with the drilling fluid through the drill bit; and (iii) Three—Wait, and then pump more gas again into the primary annulus.

In one embodiment of the present invention, the gas slug pumped down the drillstring and through the drill bit may start to affect bottom-hole pressure as soon as it passes through the bit. However, the gas flowing down the drillstring and through the drill bit into the primary annulus has no effect on the gas in the secondary annulus—i.e, the gas that was pumped into the secondary annulus to charge the secondary annulus in Step 60—until the gas flowing down through the drillstring passes the level of the top of the fluid in the secondary annulus. In an embodiment of the present invention, when the gas pumped into the drillstring reaches a level in the primary annulus that is equal to the top of the fluid in the secondary annulus, the gas volume charged in the secondary annulus starts to expand downwards through the secondary annulus. As the gas expands in the secondary annulus the pressure in the secondary annulus will fall, but the total quantity of gas in the secondary annulus is unchanged.

In an embodiment of the present invention, the quantity of gas pumped through the drillstring and into the primary annulus is the quantity of gas that provides that when the top of the flow through the primary annulus reaches the surface, the tail of the gas flow is just below the orifices. In such an embodiment, because the gas is flowing through the primary annulus at a correct/steady state flow rate, the pressure at the orifices will be close to the final steady-state pressure for the system, and hence the gas in the secondary annulus will reach down to the orifices from the top, and start flowing—thus, although the flow of gas via through the drillstring ceases after the slug of gas is injected, the drilling fluid density is reduced by the flow of gas from the secondary annulus. Once the gas in the secondary annulus reaches the nozzles/orifices it starts to flow into the primary annulus. As a result the pressure in the secondary annulus will fall at a faster rate and the total quantity of gas in the secondary annulus is reduced. In an embodiment of the present invention, at this point, in step (iii) gas is pumped again into the secondary annulus in order to maintain the required pressure and flow-rate in the borehole/primary annulus.

In one embodiment of the present invention one or more sensors are disposed along the primary annulus. These sensors may be used to measure flow properties of the gas being injected into the annulus. In one embodiment of the present invention, a processor may be used to control the gas injection into the drillstring from the surface using the properties of the gas measured by the sensors. For example, in some aspects of the present invention, gas injection into the drillstring may be stopped/reduced when the gas is detected at the surface and at the orifices/nozzles or at a time when the processor predicts that enough gas has been injected into the drillstring to create a train of gas extending from the orifices/nozzles to the surface, where such prediction may be based on measured gas flow properties from the sensors.

In one embodiment of the present invention, the three stages of pumping gas are non-overlapping in time, and operationally not pumping gas simultaneously into the drillstring and the annulus may be advantageous. However the possibility that the stages overlap—in particular in steps/stages one and two, is not precluded.

The process of charging the annulus does not have to terminate before gas is introduced into the drillstring, for example in some embodiments when the pressure at the nozzles between the secondary and primary annulus is reduced to the required level (through the action of the rising gas introduced through the drillstring), gas flow between the secondary and primary annuli is initiated. Thus, for instance, the annulus may be initially primed to a pressure equal to the pressure resulting when gas is flowing in a steady-state down the secondary annulus and up the primary annulus, and then maintained at this level. Once the gas pumped inside the drillstring has risen up above the level of the nozzles and there is communication between the gas in the annuli, additional gas will be needed to maintain the pressure and pumping will move smoothly into the stage three.

In subsequent figures, only the subsurface section of the wellbore and drilling system is shown.

Figure 3A:
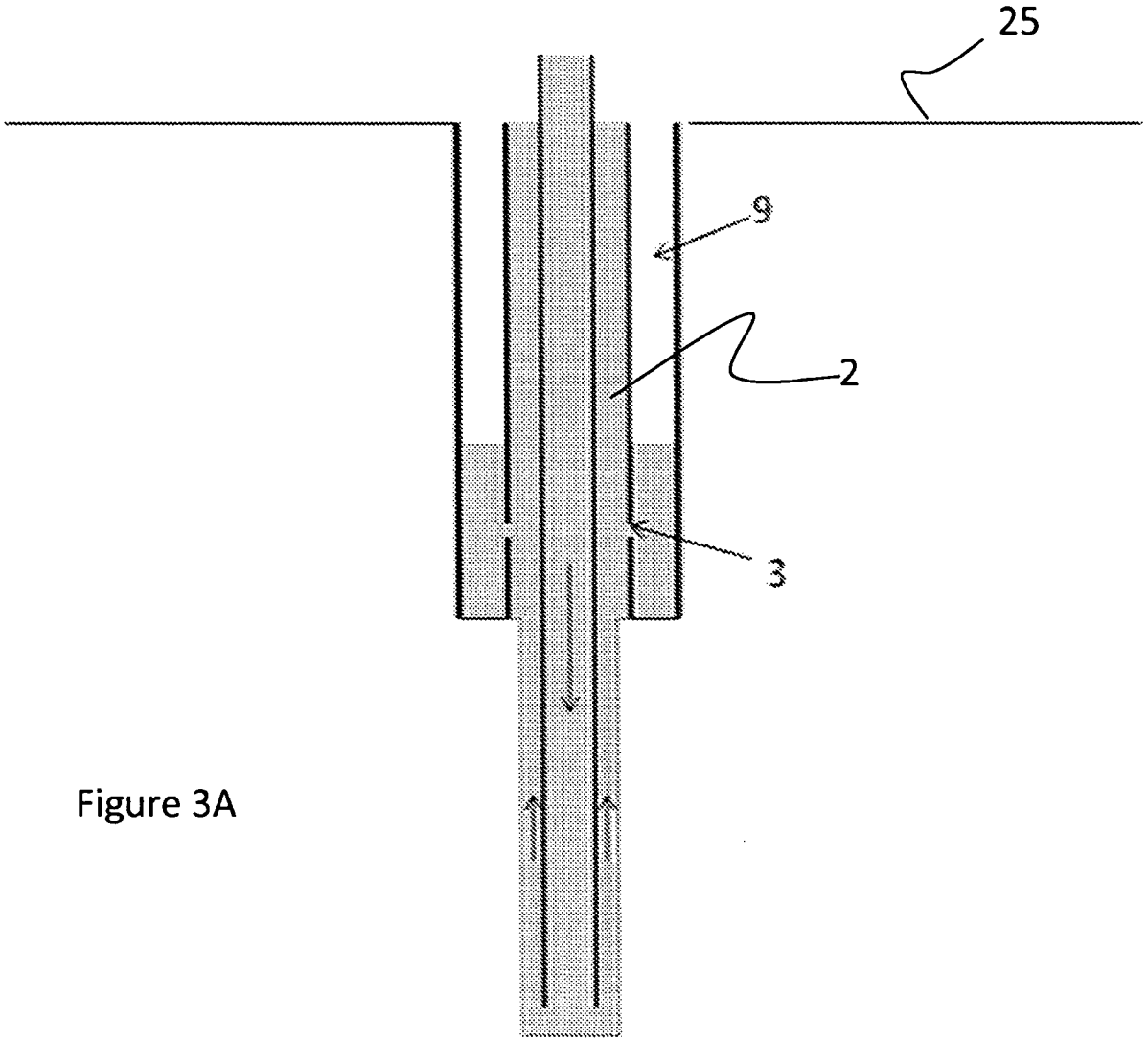
FIG. 3A depicts a first step of a managed pressure drilling process where gas is pumped into an injector to charge a drilling system, in accordance with an embodiment of the present invention.

In FIG. 3A a first step of pressure managed drilling process in accordance with one embodiment of the present invention is depicted. In the first step, gas is pumped into an outer annulus (9). The gas is pumped into the outer annulus until there is a sufficient quantity of gas to reach down through the outer annulus (9) to one or more orifices (3) that provide for fluid communication between the outer annulus (9) and an inner annulus (2). As noted above, this quantity of gas may be determined by modeling, calculation, experimentation and/or the like. In other aspects, sensors along the outer annulus (9) may be used to determine how the gas extends along the outer annulus (9).

In an embodiment of the present invention, if $P_t$ is the pressure of gas when it is flowing down the outer annulus (9), through the orifices (3) and back up the inner annulus (2), then the required gas pressure $P_0$ of the gas pumped into the outer annulus (9) in an embodiment of the present invention is given approximately by:

$$P_0=\sqrt{P_t\rho gD}$$

where:

ρ is the drilling fluid density;

g is the gravitation constant; and

D is the depth of the orifices.

In embodiments of the present invention, $P_t$ may be determined by simulation, it may be estimated from prior experience, such as the pressure obtained in previous similar operations once steady gas flow had been achieved, it may be processed/modeled or found by a combination of simulation, experience and/or processing/modeling. In an embodiment of the present invention, once $P_0$ is achieved, pumping into the outer annulus (9) ceases and the pressure is monitored in the outer annulus (9) by a pressure sensor or the like.

Figure 3B:
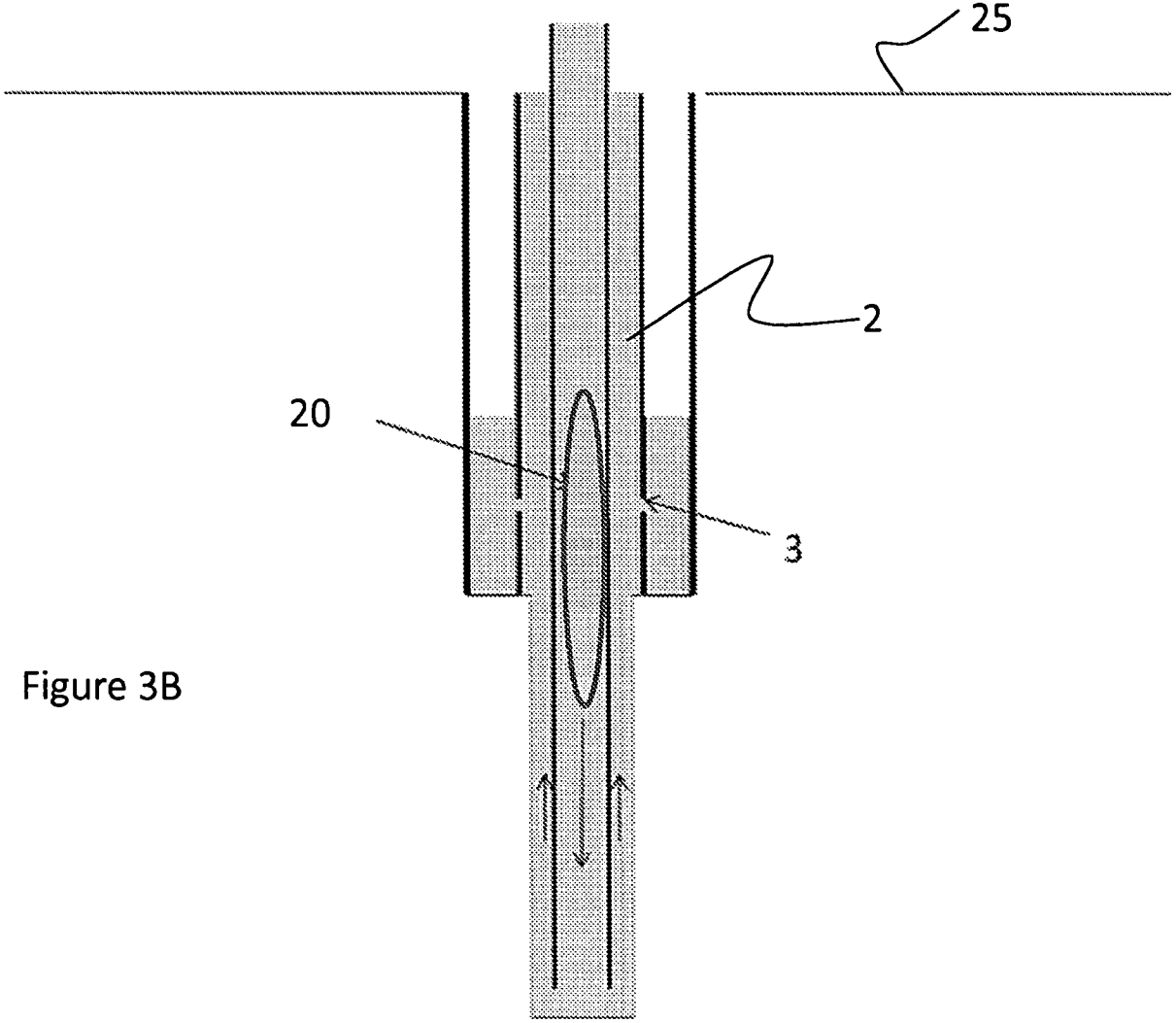
FIG. 3B depicts a second step of a managed pressure drilling operation where a gas slug is pumped down a drillstring, in accordance with one embodiment of the present invention.

FIG. 3B depicts a second step of a managed pressure drilling operation, in accordance with one embodiment of the present invention. In an embodiment of the present invention, a slug of gas (20) is pumped, together with the drilling fluid, down the drillstring and up the inner annulus (2). The volume of the slug of gas (20) that is pumped into the drillstring is calculated so as to be sufficient to produce a gas train that extends in the inner annulus (2) from a surface level (25) of the inner annulus (2) down to the orifices (3). As noted above, the volume of the slug of gas (2) may be determined by modeling, calculation, experimentation and/or the like. In other aspects, sensors along the inner annulus (2) may be used to determine how the gas extends along the outer annulus (9) and/or the flow properties of the gas on the inner annulus (2). Predictive modeling may be used to determine a volume of gas to inject into the drillstring. In some aspects of the present invention, tracers may be added to the gas injected into the drillstring and/or the outer annulus (9) so that gas flow properties may be monitored.

Figure 3C:
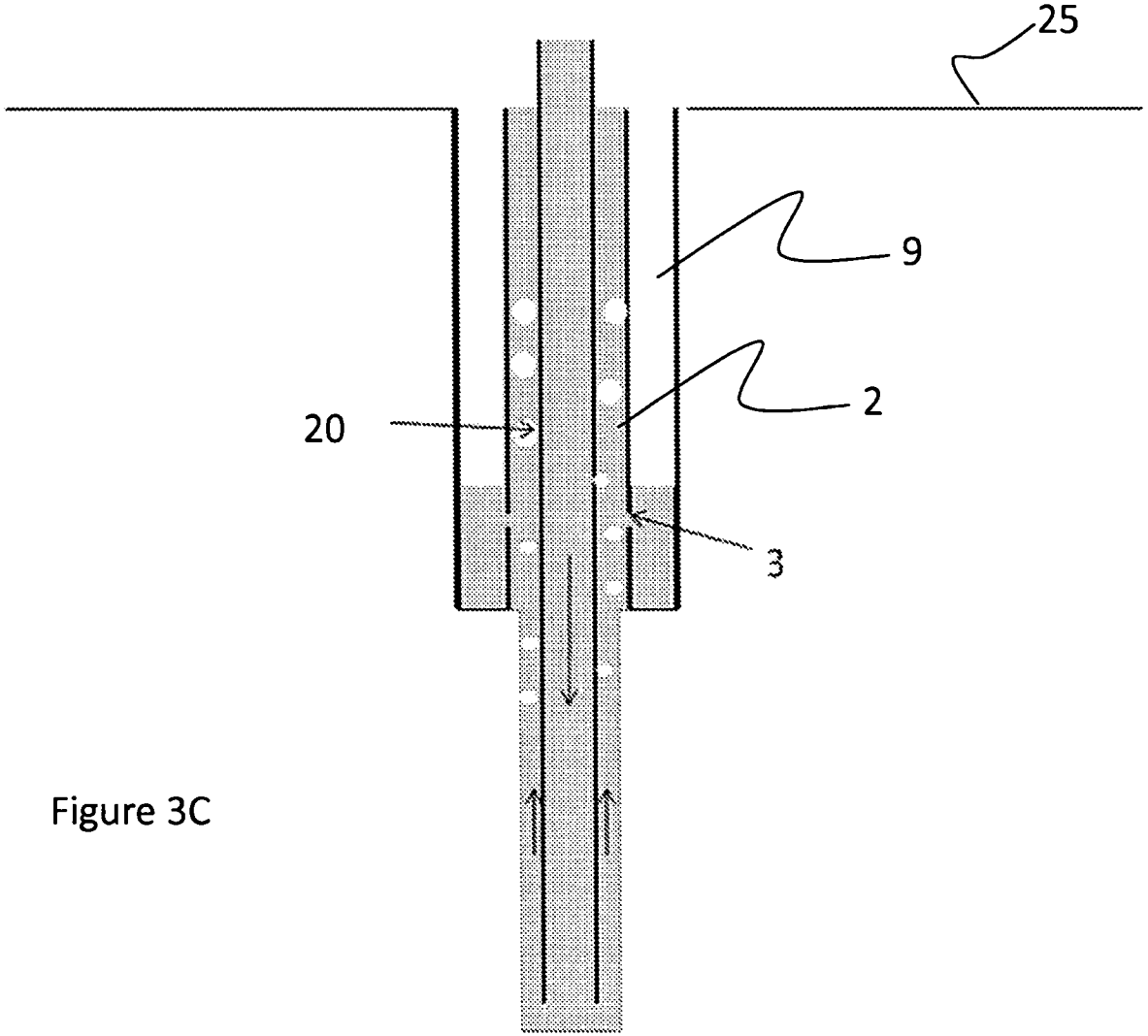
FIG. 3C depicts the situation when a gas slug is initially rising up an inner annulus, in accordance with an embodiment of the present invention.

In FIG. 3C, the situation when the gas slug (20) is rising up the inner annulus (2), but has not yet reached the surface (25) is shown. The quantity of gas to pump down the drillstring may be based on simulation, on prior experience, from testing, from modeling, processed from measurements and/or the like. Once the gas reaches the orifices (3), the liquid level in the outer annulus (9) starts to fall as the pressure at the level of the orifices (3) decreases, i.e. as gas starts to occupy a volume of the inner annulus (2) above the orifices (2) gas may flow into the inner annulus (2) from the outer annulus (9) reducing the level of fluid in the outer annulus (9).

Figure 3D:
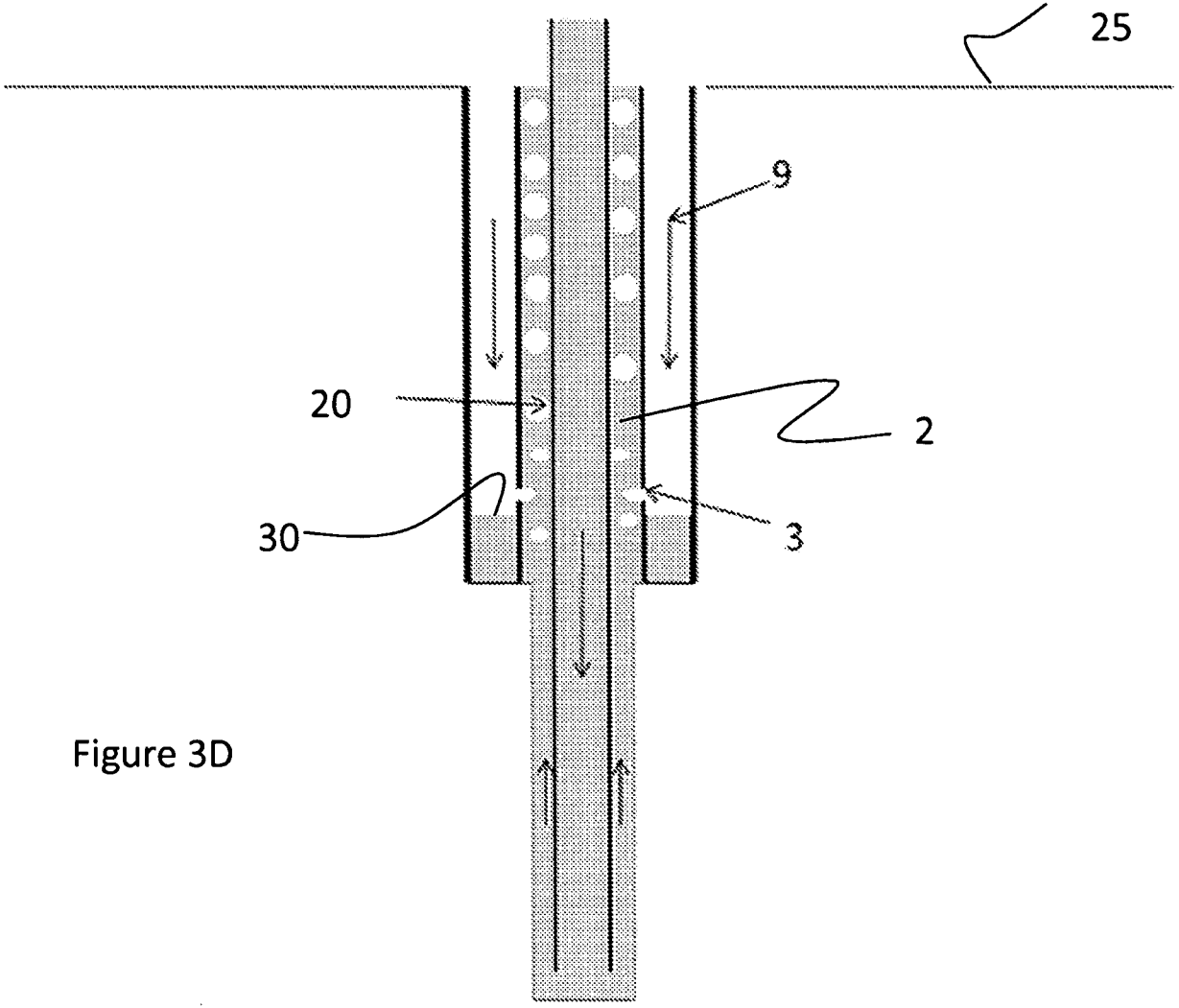
FIG. 3D illustrates a step in a managed pressure drilling operation where a gas slug in a primary annulus has reached a surface and a liquid level in a gas injector outer has gone below the orifices/injector ports providing fluid communication between the injector and the primary annulus, in accordance with an embodiment of the present invention.

FIG. 3D shows the situation once the gas slug (20) has reached the surface (25) and a liquid level (30) in the outer annulus (9) has gone below the orifices (3), in accordance with an embodiment of the present invention. Gas now flows from the outer annulus (9) to the inner annulus (2). In an embodiment of the present invention, once the gas starts to flow from the outer annulus (9) to the inner annulus (2), more gas may be pumped into the outer annulus (9) to maintain a steady state flow through the outer annulus (9) into the inner annulus (2). The decision as to when to begin pumping the gas into the outer annulus (9) may be determined from measurements of pressure or the like in the outer annulus (9). In an embodiment of the present invention, the gas flow into the outer annulus (9) may be regulated to maintain a desired downhole pressure.

In an embodiment of the present invention, a processor(s) (not shown) or the like may be used to control the quantity of gas and/or the flow rates of gas injected into the outer annulus (9) or the drillstring. In an embodiment of the present invention, as the gas flow rate through the outer annulus (9) that is necessary to achieve a desired downhole pressure increases/decreases, a processor may control the flow rate of the gas into the outer annulus (9) so as not to increase/decrease the flow rate above/below a target steady-state flow rate to achieve the required/desired downhole pressure.

In some embodiments of the present invention, other gas injectors other than the outer annulus (9) may be used to inject gas into the inner annulus (2). For example in some aspects of the present invention, gas may be injected through a tube, such as coiled tubing or the like into the inner annulus (2). In other aspects, the tubing or the like for injecting the gas may be dispose within the outer annulus (9). The same technique is used for these alternatives aspects of the present invention, but the quantity of gas injected and/or the flow rates of gas injected take into account the reduced volume of the tubing, coiled or the like.

In some embodiments of the present invention, the orifices between the outer and inner annuli may not be simple orifices, but can be more complicated arrangements of nozzles, non-return-valves or any other means of allowing gas to move from the outer to the inner annulus when the pressure in the outer annulus exceeds the pressure in the inner annulus at the depth of the nozzle.

While the principles of the disclosure have been described above in connection with specific apparatuses and methods, it is to be clearly understood that this description is made only by way of example and not as limitation on the scope of the invention.

What is claimed is:

1. A method for initiating gas injection into a borehole in a managed pressure drilling process during a drilling procedure, wherein a drillstring extends from a location at an Earth surface down into the borehole, the drillstring comprises a drill bit at an end distal from the Earth surface, a gas injector is in fluid communication with an annulus surrounding the drillstring and the fluid communication between the gas injector and the annulus is provided by one or more orifices at a depth below the Earth surface, the method comprising:

pumping a volume of gas into the gas injector to charge the gas injector to a charging pressure at which the volume of gas within the gas injector extends down towards the one or more orifices;

pumping a quantity of gas down the drillstring through the drill bit and into the annulus, wherein this quantity of gas is sufficient to produce a train of gas in the annulus extending upwardly from the one or more orifices and thereby lower pressure at the one or more orifices so that gas charged within the gas injector expands and flows through the one or more orifices into the annulus; and pumping further gas through the gas injector into the annulus at a specific flow rate to maintain the train of gas in the annulus extending from the one or more orifices to the Earth surface and produce a desired bottomhole pressure in the borehole.

2. The method of claim 1, wherein the volume of gas pumped into the injector to charge the gas injector is sufficient to extend down the injector to the one or more orifices.

3. The method of claim 1, wherein the volume of gas to charge the gas injector is determined from measurements made by one or more sensors in the injector.

4. The method of claim 1, wherein the volume of gas to charge the gas injector is determined from at least one of experimentation, prior knowledge and modeling previous gas injection processes and measurement of the gas in the inner annulus at the Earth surface.

5. The method of claim 1, wherein the quantity of gas is determined from measurements made by one or more sensors in the annulus.

6. The method of claim 1, further comprising:

using a processor to control at least one of the pumping of the gas into the injector to charge the gas injector and the pumping of the quantity of gas into the drillstring.

7. The method of claim 6, wherein the charging pressure is determined from:

$$P_0=\sqrt{P_t\rho gD}$$

where $P_0$ is the charging pressure, $P_t$ is the pressure of the gas when it flows down the gas injector and up through the inner annulus, ρ is a drilling fluid density, g is the gravitation constant.

8. The method of claim 6, further comprising using a sensor in the annulus or the gas injector to determine at least one of a pressure, flow rate and presence of the gas.

9. The method of claim 6, wherein the processor processes the quantity of gas pumped into the drill string, based on at least one of the desired bottomhole pressure, a drilling fluid weight, and a pressure in the annulus, to give a rate of flow of the gas through the annulus that produces the desired pressure at the bottom of the borehole.

10. The method of claim 1, wherein the one or more orifices comprise one or more nozzles and one or more valves.

11. The method of claim 1, wherein the gas pumped down the drillstring is entrained in a drilling fluid that is pumped down the drillstring.

12. The method of claim 1 wherein the specific flow rate is varied during the drilling procedure.

13. The method of claim 1, wherein the gas injector comprises an outer annulus surrounding cylindrical tubing that forms an outer-wall of the annulus around the drillstring.

14. The method of claim 13, wherein the cylindrical tubing comprises a casing string.

15. A system for injecting gas into a borehole during a drilling procedure, the system comprising:

an injection tubing for transporting gas;

a first pump for pumping gas into the injection tubing;

a fluid communication pathway at a depth below a surface location comprising one or more orifices between the injection tubing and an annulus surrounding a portion of a drillstring, wherein the drillstring extends from the surface location to a bottom of the borehole and the drillstring includes a drill bit at a lower end of the drillstring in the borehole for drilling the borehole through a subterranean formation during the drilling process;

a second pump for pumping gas into the drillstring and through the drill bit into the annulus; and one or more processors, wherein at least one of the one or more processors is configured to control the first pump to pump gas into the injection tubing to produce a charge pressure in the injection tubing at which the volume of gas within the injection tubing extends down towards the one or more orifices, at least one of the one or more processors is configured to control the second pump to pump gas down the drillstring and through the drill bit in a quantity sufficient to produce a train of gas in the annulus extending from the one or more orifices towards the surface location and thereby lower pressure at the orifices so that the gas within the injection tubing expands and flows through the one or more orifices into the annulus and at least one of the one or more processors is configured to control the first pump to pump further gas into the injection tubing to maintain a train of gas in the inner annulus extending from the one or more orifices to the surface location.

16. The system of claim 15, further comprising one or more sensors disposed along a length of the injection tubing.

17. The system of claim 15, further comprising one or more sensors disposed along a length of the annulus.

18. The system of claim 15, wherein the one or more processors control the first pump to pump gas into the injection tubing at a flow rate and/or pressure necessary to produce a desired bottomhole pressure.

19. The system of claim 15, wherein the one or more processors control the second pumps to pump sufficient quantity of gas into the drill string to give a rate of flow of the gas through the annulus that produces a desired bottomhole pressure and control the first pump to pump sufficient further gas into the injection tubing to maintain the rate of flow of the gas through the annulus that produces the desired bottomhole pressure.

* * * * *